US007127882B2

(12) United States Patent
Pfaeffle et al.

(10) Patent No.: US 7,127,882 B2
(45) Date of Patent: Oct. 31, 2006

(54) METHOD AND CONTROLLER FOR EXHAUST GAS TEMPERATURE CONTROL

(75) Inventors: Andreas Pfaeffle, Wuestenrot (DE); Marcel Wuest, Korntal (DE); Dirk Samuelsen, Ludwigsburg (DE); Stefan Forthmann, Ludwigsburg (DE); Michael Kolitsch, Weissach (DE); Andreas Fritsch, Waiblingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/036,420

(22) Filed: Jan. 14, 2005

(65) Prior Publication Data

US 2005/0150212 A1 Jul. 14, 2005

(30) Foreign Application Priority Data

Jan. 14, 2004 (DE) ..... 10 2004 001 881
Jul. 14, 2004 (DE) ..... 10 2004 033 969

(51) Int. Cl.
*F01N 3/00* (2006.01)
*F01N 3/10* (2006.01)

(52) U.S. Cl. ..... 60/285; 60/286; 60/287; 60/300

(58) Field of Classification Search ..... 60/285, 60/286, 287, 300
See application file for complete search history.

(56) References Cited

U.S. PATENT DOCUMENTS 6,357,226 B1 * 3/2002 Borland ..... 60/298
6,598,387 B1 * 7/2003 Carberry et al. ..... 60/297
2003/0221671 A1 * 12/2003 Bidner et al. ..... 123/406.47

FOREIGN PATENT DOCUMENTS

| | | |
|---|---|---|
| DE | 100 33 159 | 1/2002 |
| DE | 100 56 016 | 5/2002 |
| EP | 1 375 878 | 1/2004 |

* cited by examiner

*Primary Examiner*—Thomas Denion
*Assistant Examiner*—Loren Edwards
(74) *Attorney, Agent, or Firm*—Kenyon & Kenyon LLP

(57) ABSTRACT

Described is a method for controlling a temperature downstream of a catalyst in the exhaust tract of an internal combustion engine including a first control loop in which a first control variable is calculated from a first deviation that is calculated from a first actual value and a first setpoint value and influences an intra-engine heat generation. In the process, the first actual value is determined as a measure of a temperature downstream of the catalyst. The method features a second control loop in which at least one second control variable is calculated from a second deviation that is calculated from a second actual value and a second setpoint value; a temperature upstream of the catalyst being determined as the second actual value. Also described is a controller which controls the sequence of such a method.

16 Claims, 7 Drawing Sheets

| | |
|---|---|
| Fig. 3a | |
| Fig. 3b | |
| Fig. 3c | |

METHOD AND CONTROLLER FOR EXHAUST GAS TEMPERATURE CONTROL

FIELD OF THE INVENTION

The present invention relates to a method for controlling a temperature downstream of a catalyst in the exhaust tract of an internal combustion engine including a first, outer control loop in which a first control variable is calculated from a first deviation that is calculated from a first actual value and a first setpoint value; a measure of a temperature downstream of the catalyst being determined as the first actual value.

BACKGROUND INFORMATION

The present invention further relates to a controller for controlling a temperature downstream of a catalyst in the exhaust tract of an internal combustion engine including a first, outer control loop in which the controller calculates a first control variable from a first deviation that is calculated by the controller from a first actual value and a first setpoint value; a measure of a temperature downstream of the catalyst being used as the first actual value.

Such a method and controller are described in the publication "Fortschritt-Berichte VDI, Reihe 12 Verkehrstechnik/Fahrzeugtechnik, Nr. 49, 23. Internationales Wiener Motorensymposium, 25.–26. Apr. 2002, Seite 171 [VDI Progress Reports, series 12, Traffic Engineering/Vehicle Engineering, issue 49, 23, International Vienna Motor Symposium, Apr. 25–26, 2002, page 171]"; however, no details of the control are disclosed there.

Modern emission control systems generally feature a plurality of catalysts and/or filters arranged one behind the other. Thus, for example, NOx storage catalysts and particulate filters are arranged downstream of a three-way catalyst, an oxidation catalyst, or a primary catalyst in the direction of exhaust gas flow. In order for the rear catalysts in the direction of flow to function properly, specific exhaust gas temperatures are, at least temporarily, required at the inlet to these catalysts.

Thus, for example, a NOx storage catalyst, which stores nitrogen oxides when the exhaust gas is lean, is regenerated by periodically producing oxygen deficiency in the exhaust gas. Increased exhaust gas temperature promotes the regeneration. Particulate filters, such as are increasingly used in motor vehicles with diesel engines, are another example of emission control components that require certain minimum temperatures to remain functional.

To be able to maintain the absorption capacity of a particulate filter for soot over longer periods of time, the soot stored in the particulate filter must, from time to time, be burned to $CO_2$ at an elevated exhaust gas temperature. To this end, the particulate filter must, at least occasionally, be heated to above 550° C. Frequently, the particulate filter is connected to an upstream oxidation catalyst. A temperature sensor located between the oxidation catalyst and the particulate filter does provide a very accurate value for the temperature at the inlet of the particulate filter, but, due to the large heat capacity of the upstream oxidation catalyst, the temperature sensor responds only very slowly to changes in the exhaust gas temperature that are controlled upstream of the oxidation catalyst. This makes control of the exhaust gas temperature at the inlet of the particulate filter so sluggish that the response of the control to changes in the exhaust gas temperature is only fast enough when the internal combustion engine is in steady-state operation.

Since internal combustion engines in motor vehicles generally operate with rapidly varying loads and speeds involving rapid changes in the exhaust gas temperature, steady-state conditions are more of an exception than a rule. Because of this, proper regeneration of the particulate filter during normal operation of the motor vehicle becomes more difficult.

Against this background, it is an object of the present invention to provide a method and controller for exhaust gas temperature control, allowing improved control accuracy even during transient operating conditions involving exhaust gas temperatures that vary strongly when not actively controlled.

In a method of the type mentioned at the outset, this objective is achieved by a second, inner control loop in which at least one second control variable is calculated from a second deviation that is calculated from a second actual value and a second setpoint value; a temperature upstream of the catalyst being determined as the second actual value, and the second control variable influencing an intra-engine heat generation.

Moreover, in a controller of the type mentioned at the outset, this object is achieved in that the controller, in a second, inner control loop, calculates a second control variable from a second deviation that is calculated by the controller from a second actual value and a second setpoint value; a temperature upstream of the catalyst being used as the second actual value, and the second control variable influencing an intra-engine heat generation.

SUMMARY OF THE INVENTION

These measures provide an exhaust gas temperature control system that responds to changes in the exhaust gas temperature with sufficient speed and accuracy even during transient operating conditions. In the process, the accuracy of the exhaust gas temperature control is ensured by the first, outer control loop, which processes an actual value for a temperature downstream of the upstream catalyst as an input variable. This allows the temperature requirements of a downstream particulate filter or catalyst to be met with sufficient accuracy during steady-state conditions. Sufficient response speed of the control system is achieved by the parallel processing of a second actual value that is used as a measure of a temperature upstream of the upstream catalyst. The time variation of this second actual value is not influenced by the heat capacity of the upstream catalyst which, in a way acts, as a low-pass filter for changes in the exhaust gas temperature. The totality of these features provides an exhaust gas control system that produces sufficiently accurate and sufficiently fast control actions even during transient operating conditions, during which the exhaust gas temperatures can vary strongly.

As a measure of the temperature downstream of the catalyst, it is preferred to measure an actual value of the temperature downstream of the catalyst, or to determine a difference between the temperature measured downstream of the catalyst and the temperature upstream of the catalyst.

This measure allows the temperature gradient across the upstream catalyst to be taken into account in the control. In this manner, the upstream catalyst, which is generally an oxidation catalyst, or at least acts as an oxidation catalyst, can be protected from overheating. Overheating can result, for example, when unburned hydrocarbons in the exhaust gas and residual oxygen in the exhaust gas react together exothermically in the oxidation catalysts, which may actually be desired for a heating of the downstream catalyst, but which, on the other hand, should not occur to an excessive degree.

Moreover, it is preferred that the first control variable from the outer control loop act on the second setpoint value, i.e., the setpoint value of the inner control loop.

Using this measure, the second, inner control loop is controlled by the first, outer control loop so that the two control loops operate synchronously and not against each other.

It is also preferred for the first control variable to act on a post-engine heat generation.

In principle, the heat required for a heating of the emission control system can be generated by an intra-engine or post-engine process. In this context, "intra-engine heat generation" is understood to refer to generation of heat by a combustion process in combustion chambers of the internal combustion engine. In contrast to this, "post-engine heat generation" is understood to refer to generation of heat by exothermic reactions of exhaust gases from these combustion processes; these exothermic reactions no longer or, at least, only insignificantly contributing to the torque generation in combustion chambers of the internal combustion engine. An intra-engine heat generation heats the exhaust gas, and thereby the exhaust gas aftertreatment system, as it were, globally, whereas a post-engine heat generation acts more selectively on the catalytic components of the exhaust gas aftertreatment system. To protect certain parts of the exhaust gas aftertreatment system, for example, an exhaust-gas turbocharger, from overheating, intra-engine heat generation cannot be used at all operating points of the internal combustion engine. An additional amount of intra-engine heat can be generated, for example, by partial throttling, i.e., by reducing the air supply to combustion chambers of the internal combustion engine. Another alternative for increased generation of intra-engine heat is an early post-injection into combustion chambers of the internal combustion engine. In this context, "early post-injection" is understood to be an injection of fuel, where the injected fuel still participates, at least partially, in the torque-generating combustion in the combustion chamber.

On the other hand, for post-engine heat generation, the alternatives used are late post-injection of fuel into combustion chambers of the internal combustion engine, or metering of fuel directly into exhaust gas aftertreatment system of the internal combustion engine. In this context, a post-injection is considered a late post-injection if the injected fuel no longer or, at least, only insignificantly participates in the torque-generating combustion in the combustion chamber. Since post-engine heat generation allows large quantities of heat to be provided in a quick manner, and because the second control variable is calculated from the second actual value, which varies quickly during transient operating conditions, this embodiment allows heat to be quickly provided according to demand for smoothing the exhaust gas temperature profile even during transient operating conditions.

Another preferred embodiment is characterized in that the system switches between an action on the first setpoint value and a supplementary action on a post-engine heat generation, or an action on the first setpoint value and an action on the post-engine heat generation.

This embodiment also aids in selecting the heat-generating measure according to demand. In this connection, the system preferably switches to post-engine heat generation when large heat flows are required, while in the case of small heat flow requirements, the system perfectly synchronizes the control loops by acting on the first setpoint value.

It is also preferred that the post-engine heat generation be influenced by metering fuel into the exhaust gas of at least one combustion chamber of the internal combustion engine.

As mentioned earlier, this measure allows generation of a large heat flow, which selectively acts on catalytic components of the exhaust gas aftertreatment system.

Moreover, it is preferred that the metering into the exhaust gas be accomplished by at least one late post-injection of fuel into at least one combustion chamber of the internal combustion engine; the late injection taking place after a charge in the combustion chamber is burned.

This embodiment may eliminate the need for a separate metering valve in the exhaust gas aftertreatment system. The metering of fuel into the exhaust gas of the at least one combustion chamber can then be accomplished by using the fuel injector associated with this combustion chamber for both torque-generating injections and injections for increasing the exhaust gas temperature.

Another preferred embodiment is characterized in that the metering into the exhaust gas is accomplished by metering fuel into the exhaust tract upstream of the catalyst at least once.

This embodiment has the advantage that the release of heat from the additional fuel injected takes place in the exhaust gas aftertreatment system itself and, therefore, does not put thermal stress on the internal combustion engine, for example, on exhaust valves of the internal combustion engine.

Moreover, it is preferred for an action of the second control variable to take place only if the second actual value is above a predetermined threshold value.

The predetermined threshold value preferably corresponds to the initial conversion temperature in the upstream catalyst, or is higher than the initial conversion temperature. Especially with a post-engine generation of heat, this ensures that the additional fuel injected reacts exothermically in the exhaust gas aftertreatment system and generates heat. However, if the second actual value is below the predetermined threshold value, this can result in incomplete conversion of the additional fuel injected and therefore in unwanted hydrocarbon emissions from the exhaust gas aftertreatment system.

Moreover, it is preferred that the intra-engine heat generation be influenced by an early post-injection or by a delayed main injection of fuel into at least one combustion chamber of the internal combustion engine.

Using this measure, the additional fuel injected is, at least partially, burned while the torque-generating combustion in the combustion chamber is still in progress. Because the additional fuel injected contributes to the torque generation of the internal combustion engine, this measure is altogether more economical than a very late post-injection into the combustion engine or directly into the exhaust gas aftertreatment system.

It is also preferred that the intra-engine heat generation be influenced by actions on the mass of air flowing into the internal combustion engine.

The particular advantage of this embodiment is that the fuel injected for torque generation must heat a comparatively smaller amount of air. As a result, the exhaust gas temperature can be increased without significant deterioration in fuel consumption.

A further preferred embodiment is characterized in that the system switches between delayed main injection and actions on in the air mass.

The delayed main injection has the advantage over partial throttling that it allows generation of a larger heat flow. On the other hand, partial throttling is more economical. Because of the switching, the selection between the two options is made according to demand. Partial throttling is selected for low heat flow requirements, while delayed main injection is selected when an increased amount of heat flow is needed.

Furthermore, it is preferred that the setpoint value for the first control loop be selected as a function of the operating point of the internal combustion engine and a soot mass contained in the exhaust gas.

The operating point of the internal combustion engine influences the basic level of the exhaust gas temperature. The soot mass contained in the exhaust gas determines the rate at which a downstream particulate filter is loaded with soot. By selecting the setpoint value for the first control loop as a function of these two parameters, the exhaust gas temperature can be controlled to reach elevated levels according to demand.

Another preferred embodiment is characterized in that for a post-engine generation of heat, a deviation of the first actual value from the second actual value is related to an additional quantity of injected fuel, and that the deviation is used as a diagnostic criterion for the proper functioning of the catalyst.

If the catalyst is functional, the additional fuel injected reacts exothermically with oxygen contained in the exhaust gas and causes a temperature increase in the catalyst; the temperature increase manifesting itself in a difference between the two actual values mentioned. A temperature difference that is too small relative to the additional quantity of injected fuel indicates a reduced catalytic activity of the catalyst, and thus, poor functioning of the catalyst.

With regard to embodiments of the controller, it is preferred that the controller perform at least one of the method embodiments mentioned above.

It is understood that the aforementioned features and those described below can be used not only in the respective combinations specified but also in other combinations or alone without leaving the scope of the present invention.

DETAILED DESCRIPTION

Figure 1:
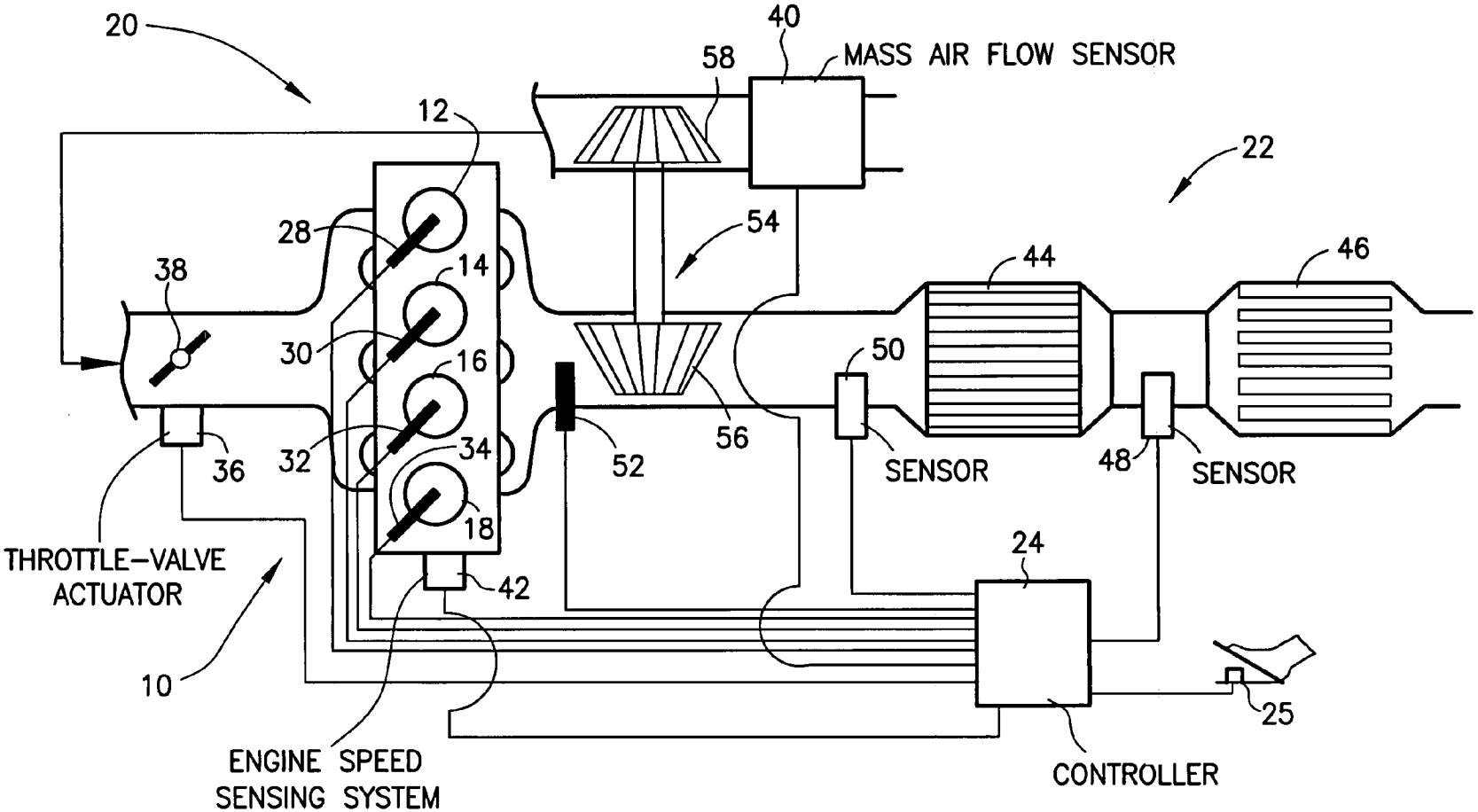
FIG. 1 schematically shows an example of a technical environment in which the present invention may be practiced.

FIG. 1 shows an internal combustion engine 10 having combustion chambers 12, 14, 16, 18, an intake pipe 20, and an exhaust gas aftertreatment system 22. Internal combustion engine 10 is controlled by a controller 24 which, especially, but not exclusively, receives the signal of a driver command sensor 25 for that purpose. Controller 24 uses the input signals to form control signals for final control elements of internal combustion engine 10. In particular, for example, controller 24 calculates fuel injection pulse widths used for opening fuel injectors 28, 30, 32, 34; each of fuel injectors 28, 30, 32, 34 injecting fuel into a specific combustion chamber 12, 14, 16, 18. The quantity of intake air flowing into internal combustion engine 10 is controlled by controller 24, possibly by driving a throttle-valve actuator 36 which controls the position of a throttle valve 38 located in intake pipe 20. The intake air mass flow rate is measured by a mass air flow sensor 40 and transmitted to controller 24. An engine speed sensing system 42 transmits signals indicative of the speed of internal combustion engine 10 to controller 24.

Exhaust gas aftertreatment system 22 includes a catalyst 44 and a further emission control component located downstream of catalyst 44 in the direction of exhaust gas flow. If internal combustion engine 10 is a diesel engine, first catalyst 44 can be an oxidation catalyst, and the emission control component can be a particulate filter 46. Moreover, exhaust gas aftertreatment system 22 necessarily includes a first temperature sensor 48 located downstream of catalyst 44 and, optionally, a second temperature sensor 50 located upstream of catalyst 44. For post-engine heat generation in exhaust gas aftertreatment system 22, a metering valve 52 is, also optionally, provided which is operated by controller 24 and allows fuel to be injected directly into exhaust gas aftertreatment system 22. In the case that internal combustion engine 10 is equipped with an exhaust-gas turbocharger 54, it is preferred for metering valve 52 to be located upstream of a turbine 56 of exhaust-gas turbocharger 54 in the direction of exhaust gas flow. Turbine 56 of exhaust-gas turbocharger 54 drives a compressor 58, which is located in intake pipe 20 of internal combustion engine 10 and supplies air to combustion chambers 28, 30, 32, 34 of internal combustion engine 10.

Sensor 48, together with controller 24, metering valve 52 and/or at least one of fuel injectors 28, 30, 32, 34, forms a first, outer control loop. In this connection, temperature sensor 48 sensor is used to detect a first actual value as a measure of a temperature downstream of catalyst 44. Controller 24 performs the task of the governor, and metering valve 52 and/or at least one of fuel injectors 28, 30, 32, 34 perform the task of a final control element for exhaust gas temperature control. Alternatively or additionally, the first, outer control loop controls the second, inner control loop.

Sensor 50, together with controller 24, throttle-valve actuator 36 and/or at least one of fuel injectors 28, 30, 32, 34, forms a second, inner control loop, in which second temperature sensor 50 provides a second actual value as a temperature upstream of the catalyst, controller 24 performs the tasks of the governor, and throttle-valve actuator 36 and/or at least one of fuel injectors 28, 30, 32, 34 perform the task of a final control element for exhaust gas temperature control.

Figures 2A, 2B, 2C:
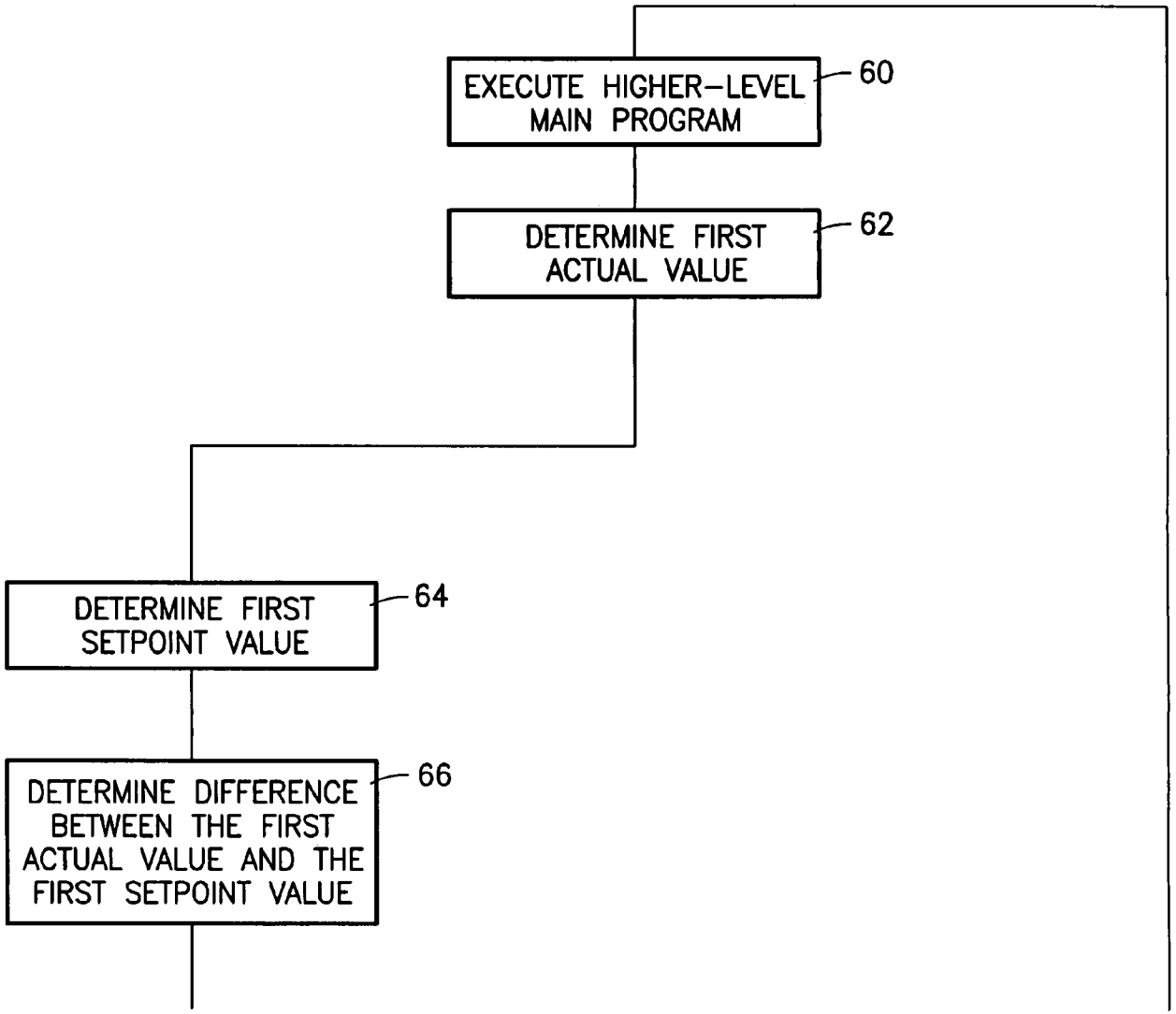
FIG. 2 is a flow chart of a first exemplary embodiment of a method according to the present invention.
Figure 2B:
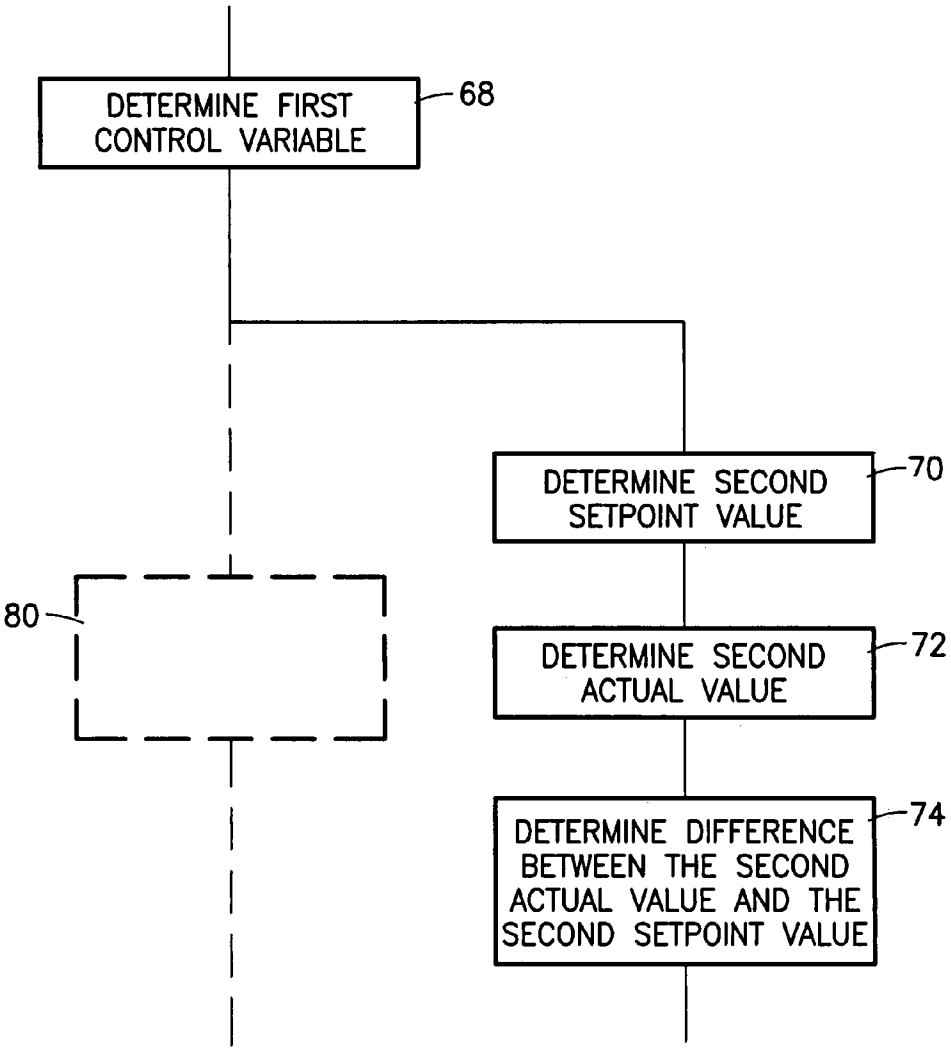
Figure 2C:
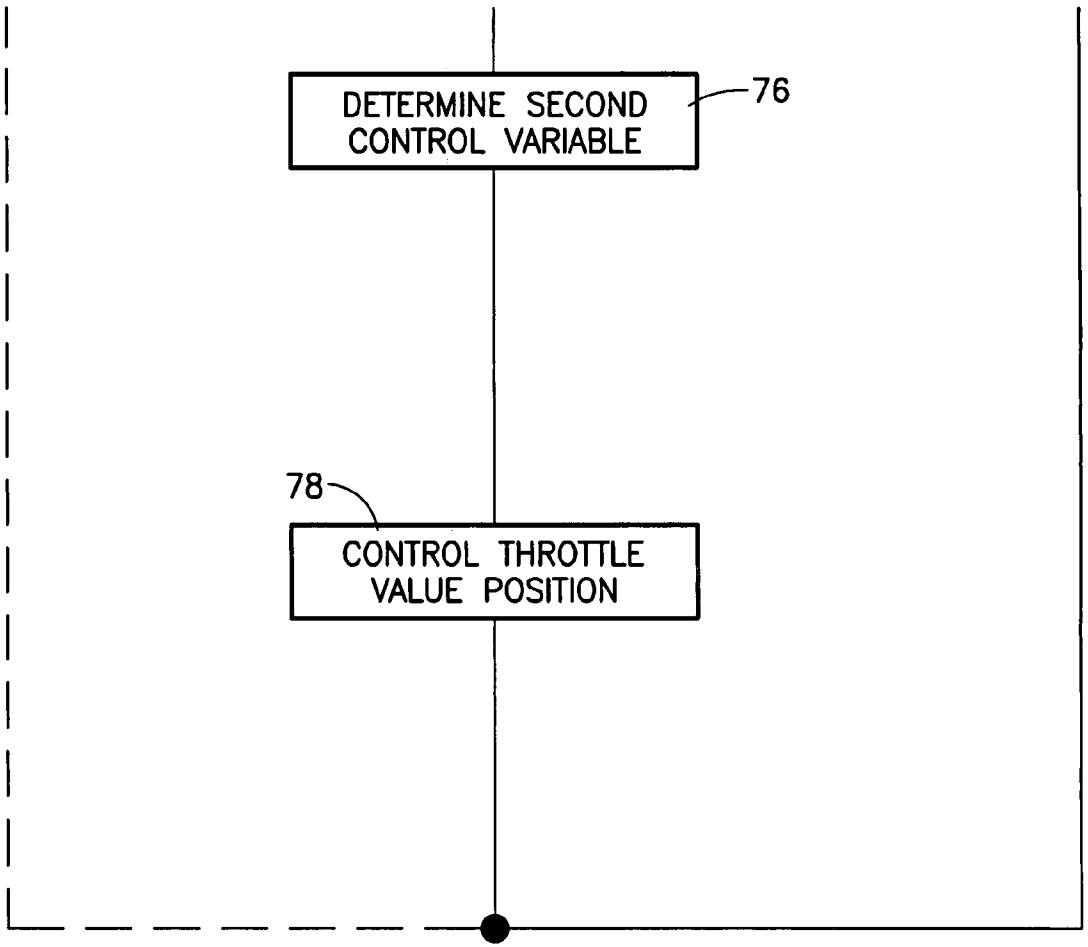

An exemplary embodiment of an inventive method that is used, for example, to control a temperature upstream of particulate filter 46 in FIG. 1 will be described below with reference to FIG. 2. In FIG. 2, step 60 represents a higher-level main program, which is used for controlling internal combustion engine 10, and is executed in controller 24. This main program branches in predefined manner, for example periodically, to a step 62, in which the first actual value, i.e., a value for the temperature downstream of catalyst 44, is determined in the first, outer control loop. This is preferably done by evaluating the signal from first temperature sensor 48.

Both first temperature sensor 48 and second temperature sensor 50 can be implemented as separate temperature sensors, or be integrated into exhaust gas sensors. For example, the determination of the internal resistance of the ceramic of a conventional lambda sensor makes it possible to draw a conclusion about the temperature of the lambda sensor, and thus also about an exhaust gas temperature at the mounting location of the lambda sensor.

In a step 64, a first setpoint value is determined for the control within the first, outer control loop. First first setpoint value is determined in step 64 preferably as a function of the operating point of internal combustion engine 10 and an instantaneous value or an integral of a soot particulate concentration in the exhaust gas. The operating point of internal combustion engine 10 is substantially defined by its speed and its generated torque which, in the case of a Diesel engine, is substantially determined by the fuel mass injected into combustion chambers 12, 14, 16, 18. If no control action is taken, a specific heat flow occurs in exhaust gas aftertreatment system 22 as a function of the operating point; the temperature in exhaust gas aftertreatment system 22 being determined to a considerable degree also by this heat flow.

By taking into account the soot particulate concentration, it is possible, in particular, to take the loading condition of particulate filter 46 into account in the determination of the setpoint value. Regeneration is initiated, if necessary, by an exhaust gas temperature increase caused by an increase in the setpoint value when the loading condition of particulate filter 46 reaches a threshold at which regeneration is required.

The determination of the first setpoint value in step 64 is followed by a step 66, in which a deviation is calculated as a difference between the first setpoint value and the first actual value. This deviation is used in step 68 to calculate a first control variable. The first control variable calculated in step 68 preferably acts on the determination of a second setpoint value for the second, inner control loop in step 70. In step 72, the second actual value is calculated from the signal from second temperature sensor 50 and, in step 74, the second deviation is calculated and used in step 76 to calculate the second control variable for the exhaust gas temperature control. The second control variable preferably influences an intra-engine heat generation, for example, by partially throttling the intake air mass flow in step 78 by controlling throttle valve 38 to close. From step 78, the program branches back to the main program for controlling the internal combustion engine in step 60.

Within the scope of the exhaust gas temperature control, the described sequence of steps including steps 60 through 78 is performed repeatedly. As described hereinbefore, the first control variable calculated in step 68 influences the calculation of the second setpoint value for the second, inner control loop in step 70. Alternatively, or in addition to such an action on the second setpoint value, the first control variable from step 68 can also be used to act on a post-engine heat generation in step 80. Post-engine heat generation is caused, for example, by opening metering valve 52 by which fuel is introduced directly into exhaust gas aftertreatment system 22, where it reacts exothermically with oxygen. Alternatively or additionally, post-engine heat generation can also be accomplished by a late post-injection into at least one of combustion chambers 12, 14, 16, 18 of internal combustion engine 10.

As an alternative to measuring an actual value of the temperature downstream of catalyst 44, a difference between the temperature measured downstream of catalyst 44 and the temperature upstream of catalyst 44 can be determined as a measure of the temperature downstream of catalyst 44. Such a difference provides a relative measure of the temperature downstream of catalyst 44, which is related to the temperature upstream of catalyst 44.

Figure 3A:
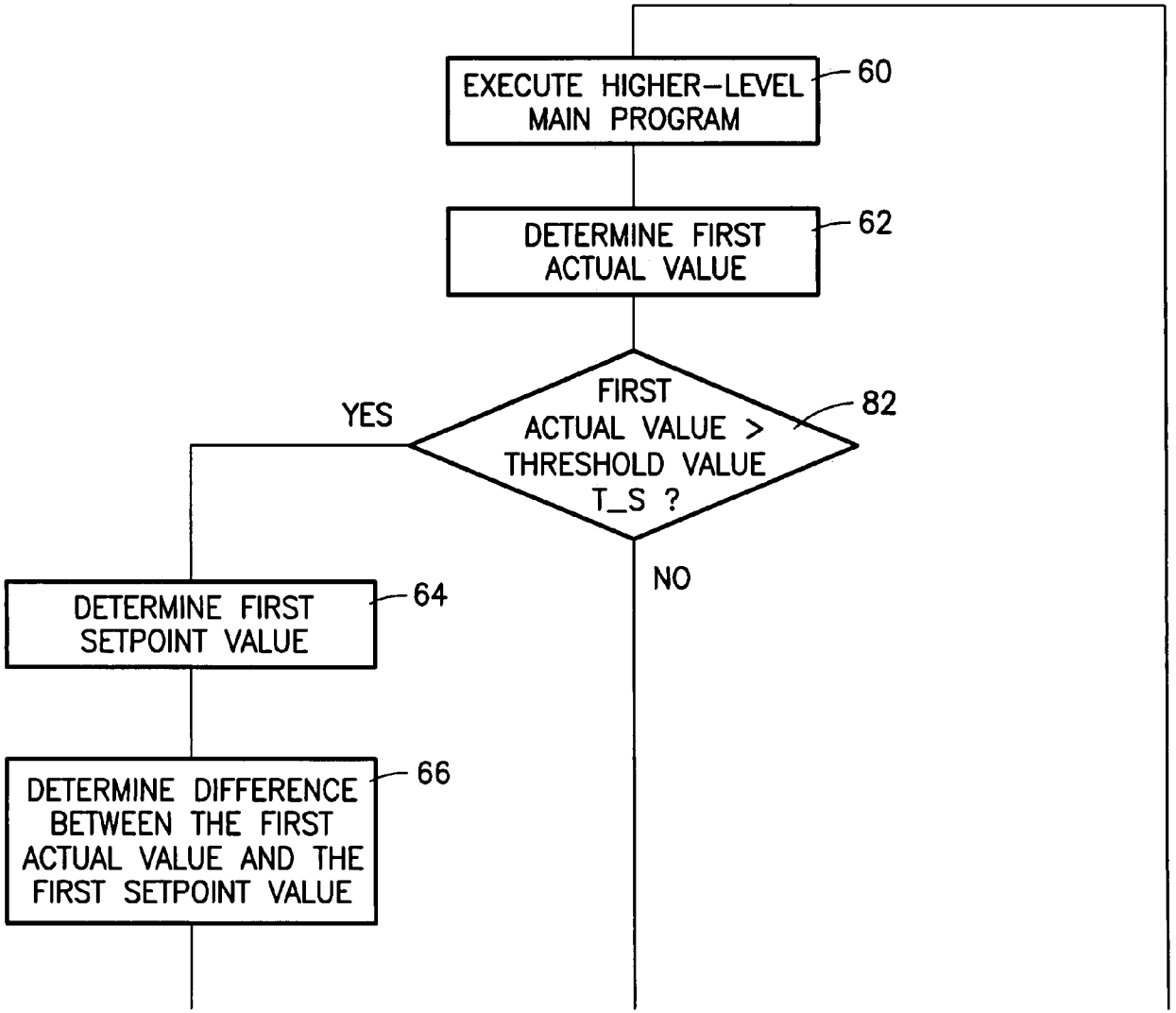
FIG. 3 is another flow chart illustrating further embodiments of the method according to FIG. 2.
Figure 3B:
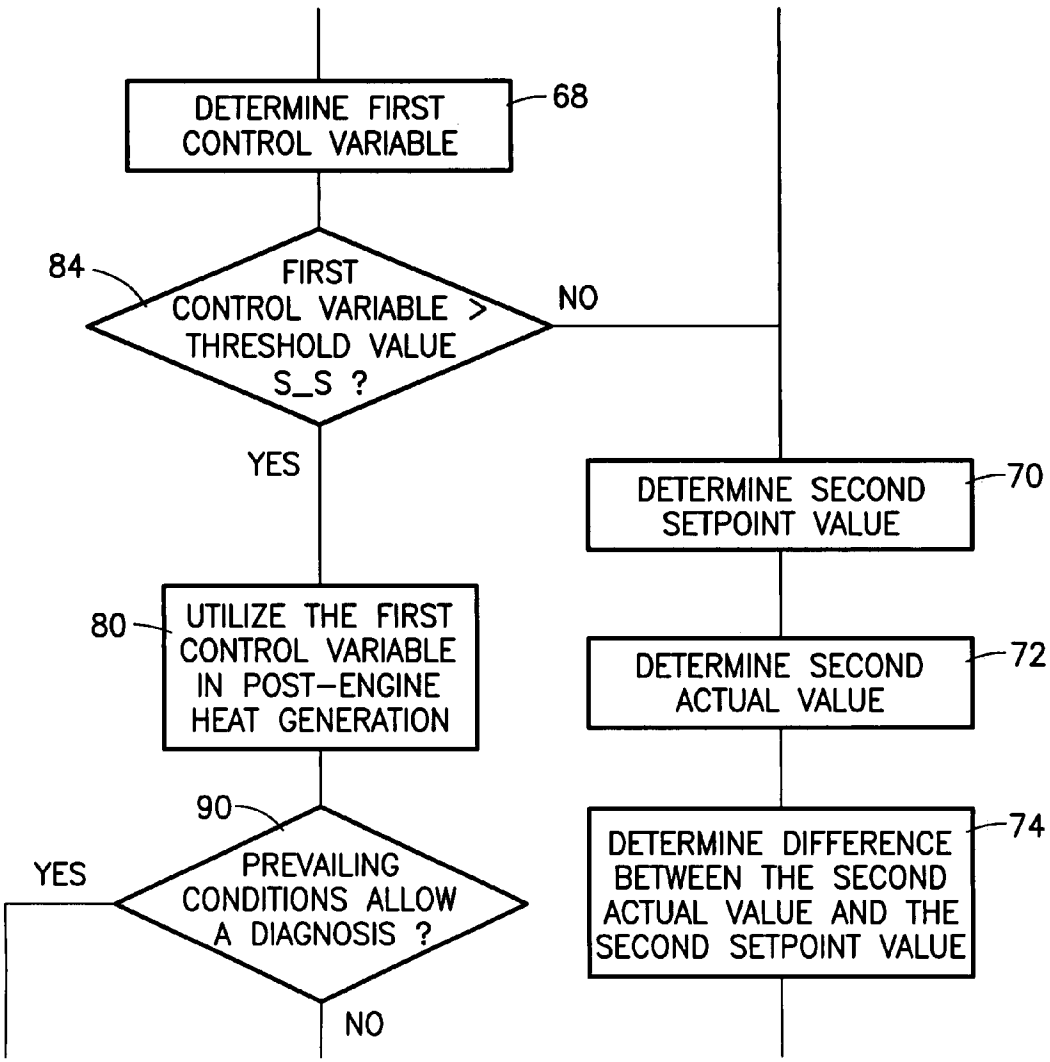
Figure 3C:
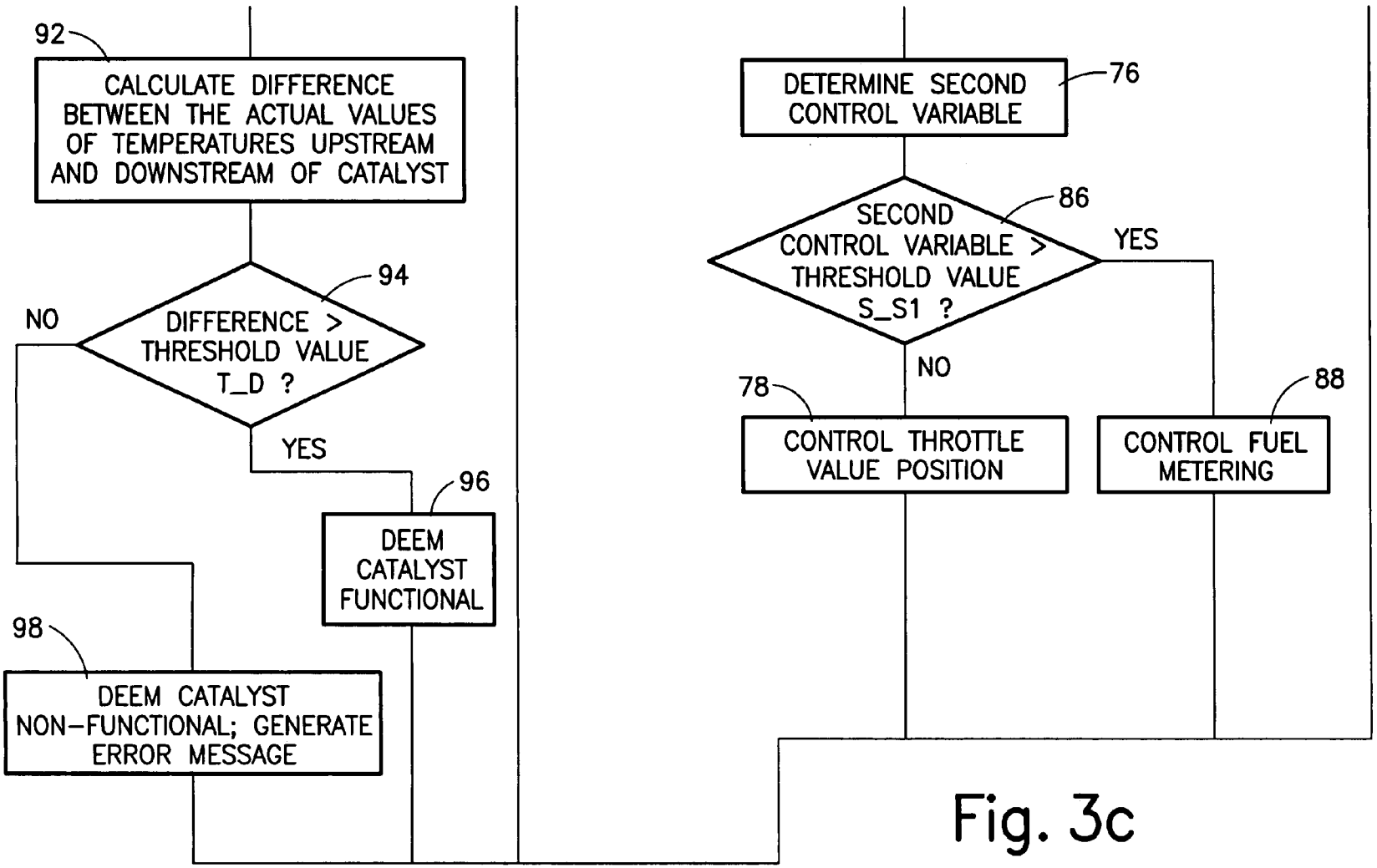

FIG. 3 shows different embodiments of the method according to FIG. 2, each of which can be used both separately and in combination with each other. Thus, after determining the second actual value as a measure of the temperature upstream of catalyst 44, a step 82 is performed to switch between activation and deactivation of the first, outer control loop according to demand. To this end, a check is made in step 82 whether the first actual value exceeds a threshold value T_S. If the answer to the inquiry is "yes", the first, outer control loop is activated by branching to step 64, in which the first setpoint value is calculated. However, if the answer to the inquiry in step 82 is "no", the first, outer control loop is deactivated by branching to step 70, in which the second setpoint value is determined for the control within the second, inner control loop. In this embodiment, the first control variable performs an action only if the first actual value is above a predetermined threshold value. When the first control loop is deactivated, then, in particular, no post-engine heat generation occurs in step 80.

By inserting inquiry 84 after the calculation of the first control variable in step 68, it is possible to switch from an action of the first control variable on a post-engine heat generation in step 80 to an action on the second setpoint value. To this end, a check is made in step 84 whether the first control variable exceeds a predetermined threshold value S_S. Exceeding of this threshold value correlates with a high heat flow to be provided quickly, which can be accomplished by a post-engine heat generation in step 80. However, if the first control variable falls below this threshold value, a branch is made to step 70, in which the second setpoint value is calculated.

Similarly, in another embodiment, step 86 can be used to switch between partial throttling by acting on the position of throttle valve 38, and initiation of an early post-injection or a delayed main injection via at least one of fuel injectors 28, 30, 32, 34 as a means of intra-engine generation of heat. The selection can be made by comparing the second control variable calculated in step 76 to a threshold value S_S1. In the case of small control variables, it is preferred to act on the throttle valve position in step 78, while in the case of larger control variables, it is preferred to act on the fuel metering in step 88. In general terms, a check is made in step 86 whether conditions are satisfied which allow the requested heat flow to be established by the preferred partial throttling.

In another embodiment, step 90 is used to initiate a diagnosis. If in step 90, which is reached only in connection with a post-engine heat generation in step 80, conditions are detected that allow a diagnosis, a branch is made to a sequence of diagnosis steps 92, 94, 96/98. Conditions allowing a diagnosis are given, for example, if the post-engine heat generation has already been active for a period of time sufficient to establish a temperature gradient across catalyst 44. If these conditions are given, a difference between the actual values of the temperatures upstream and downstream of catalyst 44 is calculated in step 92.

In this connection, the temperature upstream of catalyst 44 can also be calculated in controller 24 from operating parameters of internal combustion engine 10 using a temperature model instead of being measured by second temperature sensor 50.

In step 94, a check is made whether the difference exceeds a threshold value T_D that can be calculated, for example, as a function of the heat generated in a post-engine process. If this threshold value is exceeded, the catalyst is considered functional, which is stored in step 96. However, if the difference falls below this threshold value, catalyst 44 is considered non-functional and, in step 98, an error message occurs which, for example, produces an entry in a fault memory of controller 24.

What is claimed is:

1. A method for controlling a temperature downstream of a catalyst in an exhaust tract of an internal combustion engine, comprising:

determining a first actual value as a measure of the temperature downstream of the catalyst;

calculating a first deviation from the first actual value and a first setpoint value;

in a first, outer control loop, calculating a first control variable from the first deviation;

calculating a second deviation from a second actual value and a second setpoint value;

in a second, inner control loop, calculating at least one second control variable from the second deviation; and determining a temperature upstream of the catalyst as the second actual value, wherein the at least one second control variable influences an intra-engine heat generation.

2. The method as recited in claim 1, wherein one of:

the determining of the first actual value includes determining the first actual value by measurement, and determining a difference between the temperature measured downstream of the catalyst and the temperature upstream of the catalyst.

3. The method as recited in claim 1, wherein the first control variable acts on the second setpoint value.

4. The method as recited in claim 1, wherein the first control variable acts on a post-engine heat generation.

5. The method as recited in claim 3, further comprising:

switching one of between an action on the first setpoint value and a supplementary action on a post-engine heat generation, and between an action on the first setpoint value and an action on the post-engine heat generation.

6. The method as recited in claim 4, further comprising:

influencing the post-engine heat generation by metering a fuel into an exhaust gas of at least one combustion chamber of the internal combustion engine.

7. The method as recited in claim 6, wherein:

the metering includes performing at least one late post-injection of the fuel into the at least one combustion chamber of the internal combustion engine, the at least one late post-injection occurring after a charge in the at least one combustion chamber is burned.

8. The method as recited in claim 6, wherein:

the metering includes metering the fuel into the exhaust tract upstream of the catalyst at least once.

9. The method as recited in claim 1, wherein:

an action of the at least one second control variable occurs only if the second actual value is above a predetermined threshold value.

10. The method as recited in claim 1, wherein:

in a first influencing operation, the intra-engine heat generation is influenced by one of an early post-injection and a delayed main injection of a fuel into at least one combustion chamber of the internal combustion engine.

11. The method as recited in claim 10, wherein:

in a second influencing operation, the intra-engine heat generation is influenced by an action on a mass of air flowing into the internal combustion engine.

12. The method as recited in claim 11, further comprising:

switching between the first influencing operation and the second influencing operation.

13. The method as recited in claim 1, further comprising:

selecting the first setpoint value as a function of an operating point of the internal combustion engine and a soot mass contained in an exhaust gas.

14. The method as recited in claim 6, wherein:

for a post-engine generation of heat, a deviation of the first actual value from the second actual value is related to an additional quantity of injected fuel, and the deviation of the first actual value from the second actual value is used as a diagnostic criterion for a proper functioning of the catalyst.

15. A controller for controlling a temperature downstream of a catalyst in an exhaust tract of an internal combustion engine, comprising:

an arrangement for determining a first actual value as a measure of the temperature downstream of the catalyst;

an arrangement for calculating a first deviation from the first actual value and a first setpoint value;

a first, outer control loop for calculating a first control variable from the first deviation;

an arrangement for calculating a second deviation from a second actual value and a second setpoint value;

a second, inner control loop for calculating at least one second control variable from the second deviation; and an arrangement for determining a temperature upstream of the catalyst as the second actual value, wherein the at least one second control variable influences an intra-engine heat generation.

16. The controller as recited in claim 15, further comprising:

an arrangement for switching one of between an action on the first setpoint value and a supplementary action on a post-engine heat generation, and between an action on the first setpoint value and an action on the post-engine heat generation.

* * * * *